United States Patent [19]

Erickson

[11] Patent Number: 4,777,803

[45] Date of Patent: Oct. 18, 1988

[54] AIR PARTIAL EXPANSION REFRIGERATION FOR CRYOGENIC AIR SEPARATION

[76] Inventor: Donald C. Erickson, 1704 S. Harbor La., Annapolis, Md. 21401

[21] Appl. No.: 946,484

[22] Filed: Dec. 24, 1986

[51] Int. Cl.[4] ..... F25J 3/04

[52] U.S. Cl. ..... 62/22; 62/25; 62/29; 62/38; 62/44

[58] Field of Search ..... 62/11, 22, 23, 24, 25, 62/27, 29, 34, 36, 38, 39, 40, 42, 43, 44

[56] References Cited

U.S. PATENT DOCUMENTS

| | | | |
|---|---|---|---|
| 4,578,095 | 3/1986 | Erickson | 62/29 X |
| 4,582,518 | 4/1986 | Erickson | 62/29 X |
| 4,604,116 | 8/1986 | Erickson | 62/22 X |
| 4,662,917 | 5/1987 | Cormier, Sr. et al. | 62/39 X |
| 4,670,031 | 6/1987 | Erickson | 62/39 X |

FOREIGN PATENT DOCUMENTS

| | | |
|---|---|---|
| 2854508 | 6/1980 | Fed. Rep. of Germany . |
| 845542 | 7/1984 | South Africa . |
| 756150 | 8/1980 | U.S.S.R. . |
| 1271419 | 4/1972 | United Kingdom . |

*Primary Examiner*—Steven E. Warner

[57] ABSTRACT

The invention provides an improved means of producing the refrigeration required for any fractional distillation air separation process. The improved refrigeration technique causes the distillation columns to operate more efficiently, and thereby permits increased recovery and/or purity of product at lower energy input. Referring to FIG. 3, refrigeration air is partially expanded in expander 313, then condensed by exchanging latent heat with depressurized kettle liquid in condenser 314, and the resulting liquid air is split and used to reflux both columns 307 and 305 via pump 316 and valve 315 respectively.

17 Claims, 4 Drawing Sheets

210
211
215
212
214
209
216
205
GN2
208
207
206
204
LOX
202
202
213
E
C
201
N2
O2
AIR

AIR PARTIAL EXPANSION REFRIGERATION FOR CRYOGENIC AIR SEPARATION

TECHNICAL FIELD

This invention relates to processes and apparatus for separating air into oxygen of any purity and optional coproduct argon via cryogenic fractional distillation. The invention makes possible a substantial reduction in the energy hitherto required for these products, by incorporating a novel refrigeration method which increases the efficiency of the fractional distillations.

BACKGROUND ART

Conventional cryogenic air separation processes normally involve at least two fractional distillation columns: a "low pressure" column, from which is withdrawn fluid oxygen bottom product of specified purity plus gaseous nitrogen overhead product, plus a "high pressure rectifier" which receives the feed air, provides a reboil to the LP column and $LN_2$ reflux for both columns by indirect exchange of latent heat between the two columns, and provides oxygen enriched liquid air bottom product (kettle liquid) which is subsequently fed to the LP column.

The conventional flowsheets provide the bulk of the refrigeration necessary for the overall separation process in either of two conventional manners: by work expanding either part of the HP rectifier overhead nitrogen to exhaust pressure (slightly below LP column overhead pressure), or expanding part of the feed air to LP column intermediate height pressure. U.S. Pat. No. 3,327,488 illustrates the above two approaches in the same flowsheet, although for economic reasons usually only one or the other is used.

The refrigeration compensates for heat leaks, heat exchanger inefficiency, and other effects. Even with the most modern and efficient expanders, there is still required an expander flow of between about 8 and 15% of the inlet air flow to provide the necessary refrigeration, dependent on the size and design of the separation plant. This flow represents a loss of process efficiency, which can be manifested in various ways: lower recovery and/or purity of oxygen than would otherwise be possible; lower recovery and/or purity of coproduct argon; more machinery (and capital cost) to achieve acceptable recoveries and purities; or lower $O_2$ delivery pressure than would otherwise be possible.

The conventional refrigeration techniques have no beneficial effect on the efficiency of operation of the fractional distillation columns. Column efficiency is indicated by closeness of operating and equilibrium lines, that is by the absence of mixing of streams of greatly differing composition and/or temperature. A new refrigeration technique which interacts with the distillation columns so as to make them operate more efficiently would be advantageous even if the refrigeration technique per se were no more efficient than the conventional refrigeration techniques. That is one objective of the present disclosure.

One alternative means for providing refrigeration has been disclosed in the prior art which beneficially interacts with a distillation column. As disclosed in U.S. Pat. No. 4,543,115 and British Patent No. 1271419, it is possible to work-expand part of the supply air to an intermediate pressure which is sufficiently higher than LP column pressure such that the partially expanded air will exchange latent heat with LP column intermediate height liquid in an intermediate reboiler. The air totally condenses while providing intermediate reboil to the LP column. The liquid air is subsequently depressurized to LP column pressure and fed to a height above the intermediate reboiler height. The LP column operates more efficiently due to the intermediate reboil below the feed point. On the other hand, the reduced pressure ratio of expansion of the refrigeration air necessitates a greater mass flow to obtain a given amount of refrigeration. Thus more air bypasses the HP rectifier, and the separation is made more difficult. This effect largely negates any benefit from improved LP column efficiency. Overall, the absence of a net thermodynamic benefit coupled with the disadvantage of requiring an additional item of capital equipment (the intermediate reboiler) have prevented this refrigeration technique from being used in any known application during the 15 years it has been publicly disclosed.

What is needed, and one objective of this invention, are improvements to this mode of refrigeration for an air separation process which further improve column operating efficiency, which reduce the amount of air required to be fed to the expander, and which reduce the amount and cost of added capital equipment. Furthermore, it is desired to obtain these improvements in flowsheets for the production of high purity oxygen plus coproduct argon, in addition to the more conventional flowsheets for the production of low to medium purity oxygen or high purity nitrogen.

It is known to reboil the bottom of the LP column by latent heat exchange with any of three gases: HP rectifier overhead $N_2$; partially condensing feed air (U.S. Pat. Nos. 3,113,854, 3,371,496, 3,327,489, 3,688,513, and 4,578,095); or totally condensing feed air (U.S. Pat. No. 3,210,951, 4,208,199, and 4,410,343). Similarly it is known to evaporate the liquid oxygen bottom product of the LP column to gaseous oxygen product by latent heat exchange with any of the same three gases. U.S. Pat. Nos. 3,113,854, 3,371,496, 3,327,489, and 4,560,398 disclose partial condensation LOXBOIL, while U.S. Pat. Nos. 3,210,951, 4,133,662, 4,410,343, and 4,507,134 disclose total condensation LOXBOIL.

U.S. Pat. Nos. 3,210,951 and 4,410,343 both show a single heat exchanger in which about 40 to 56% of the feed air is totally condensed to provide both LOXBOIL and LP column reboil, and then the liquid air is divided and fed to both columns.

When the LP column is reboiled by HP rectifier $N_2$, whereas LOXBOIL is via condensation, the LOXBOIL pressure is somewhat higher than the LP column bottom pressure. Although that pressure increase could be accomplished by a liquid oxygen pump, a preferred method is to use the barometric or hydrostatic head of a column of liquid oxygen, i.e., boil the LOX at a suitably lower elevation than the LP column bottoms reboiler. This is disclosed in U.S. Pat. Nos. 4,133,662, 4,507,134, 4,560,398, and South African application No. 845542 dated July 18, 1984 filed by Izumichi and Ohyama.

It is known to depressurize the HP rectifier bottom liquid (kettle liquid) and then reflux the HP rectifier by exchanging latent heat between HP rectifier overhead vapor and the depressurized kettle liquid. The evaporated kettle liquid is then fed to the LP column. This is disclosed in U.S. Pat. Nos. 4,410,343, 4,439,220, and 4,582,518.

It is known to apply the work developed by the refrigeration expander toward additional warm end compression of part of the compressed air supply. The further compressed air may then be used for conventional refrigeration (German patent application No. 845542 published 06/19/80 and filed by Rohde), or for TC LOXBOIL (U.S. Pat. No. 4,133,662, USSR Pat. No. 756150, and South African application No. 2854508 (supra)).

When adding intermediate reflux to a distillation column, the initial amount added allows a virtually one-for-one reduction in the overhead reflux (for specified recovery and purity). The benefit from intermediate reflux continues to increase as more is added until a "pinch" is reached: the operating line closely approaches the equilibrium line. Further additions of intermediate reflux beyond that point decrease the benefit, i.e., provide no more decrease in the amount of overhead reflux required. For an air separation process wherein liquid air is used as intermediate reflux, the optimal amount of liquid air reflux is about 5 to 10% of the feed air, for both the LP column and the HP rectifier. Greater liquid air flow rates do not provide any further decrease in the overhead reflux requirement.

Thus in summary air partial expansion refrigeration as disclosed in the prior art causes (1) an advantageous reduction in the LP column overhead reflux requirement; (2) no change in the HP rectifier overhead reflux requirement; (3) a disadvantageous decrease in the reboil through the HP rectifier and the lower section of the LP column; and (4) a disadvantageous increase in capital equipment.

The combination of AIRPER refrigeration plus warm companding of the refrigeration air was disclosed by applicant in U.S. Pat. No. 4,670,031, which is incorporated by reference.

Fractional distillation refers to the process of separating a mixture of two or more volatile substances into at least two fractions of differing volatility and composition by countercurrent vapor-liquid contact whereby a series of evaporation and condensations occur. "Intermediate height" of a fractional distillation columns signifies a location having countercurrent vapor-liquid contact stage(s) both above and below it.

DISCLOSURE OF INVENTION

The air partial expansion refrigeration (AIRPER) technique is improved by splitting the liquid into two roughly equal portions (no greater than 3 to 1 ratio) and feeding one each to the HP rectifier and the LP column as respective intermediate refluxes. This reduces the HP rectifier overhead reflux requirement in addition to the LP column requirement, and hence the total reduction is greater. This is important for flowsheets which are otherwise deficient in $LN_2$ reflux, such as processes requiring substantial amounts of HP $GN_2$ coproduct or high purity $O_2$ flowsheets with argon coproduct wherein it is also desired to PC LOXBOIL. Since the condensed air is at an intermediate pressure (between that of the HP rectifier and the LP column), it is necessary to first increase the pressure of the fraction to be routed to the HP rectifier.

The AIRPER technique is also improved by maximizing the pressure ratio of the expansion, which minimizes the mass flow rate through the expander (and hence the amount of reboil bypassing the HP rectifier and lower section of the LP column). The most important measure to accomplish this is to condense the air at the coldest possible temperature which is possible from the perspective of supplying the needed intermediate reboil to the LP column (also referred to as the "$N_2$ rejection or removal column"). In order to do that, the partially expanded air must be condensed by latent heat exchange with either or both of two liquids: depressurized kettle liquid, and/or LP column liquid from approximately the same height as the feed height for the kettle liquid (which kettle liquid may be at least partially evaporated at that point, depending on the remainder of the flowsheet).

Either of the above measures taken singly yields a substantial improvement to an air separation process incorporating AIRPER refrigeration. Most preferred are processes which incorporate both measures, thereby achieving very substantial increases in distillation efficiency over conventional processes. The required mass flow rate through the refrigeration expander can be advantageously further reduced by warm companding which is also preferred. However, this provides no further relative improvement over conventional flowsheets, because they can also incorporate warm companding of the expander supply.

In summary, process and apparatus are disclosed for cryogenic separation of air to oxygen product plus optional crude argon coproduct comprising:

(a) supplying an uncondensed fraction of the supply air to high pressure (HP) rectifier;

(b) withdrawing overhead liquid from the HP rectifier and feeding at the least part of it to a low pressure nitrogen removal column as overhead reflux therefor;

(c) work expanding a minor fraction of the supply air to an intermediate pressure;

(d) condensing the expanded air by exchanging latent heat with at least one of $N_2$ removal column intermediate height liquid and at least part of the HP rectifier bottom liquid (kettle liquid); and (e) splitting the resulting liquid air into at least two fractions and feeding one fraction to an intermediate reflux height of the HP rectifier and another to the $N_2$removal column.

The above improved refrigeration technique finds advantageous application in any type of air fractional distillation process: oxygen or nitrogen primary product, gas and/or liquid primary product; and any $O_2$ purity, including especially high purity $O_2$ including crude argon coproduct.

BEST MODE FOR CARRYING OUT THE INVENTION

Figure 1:
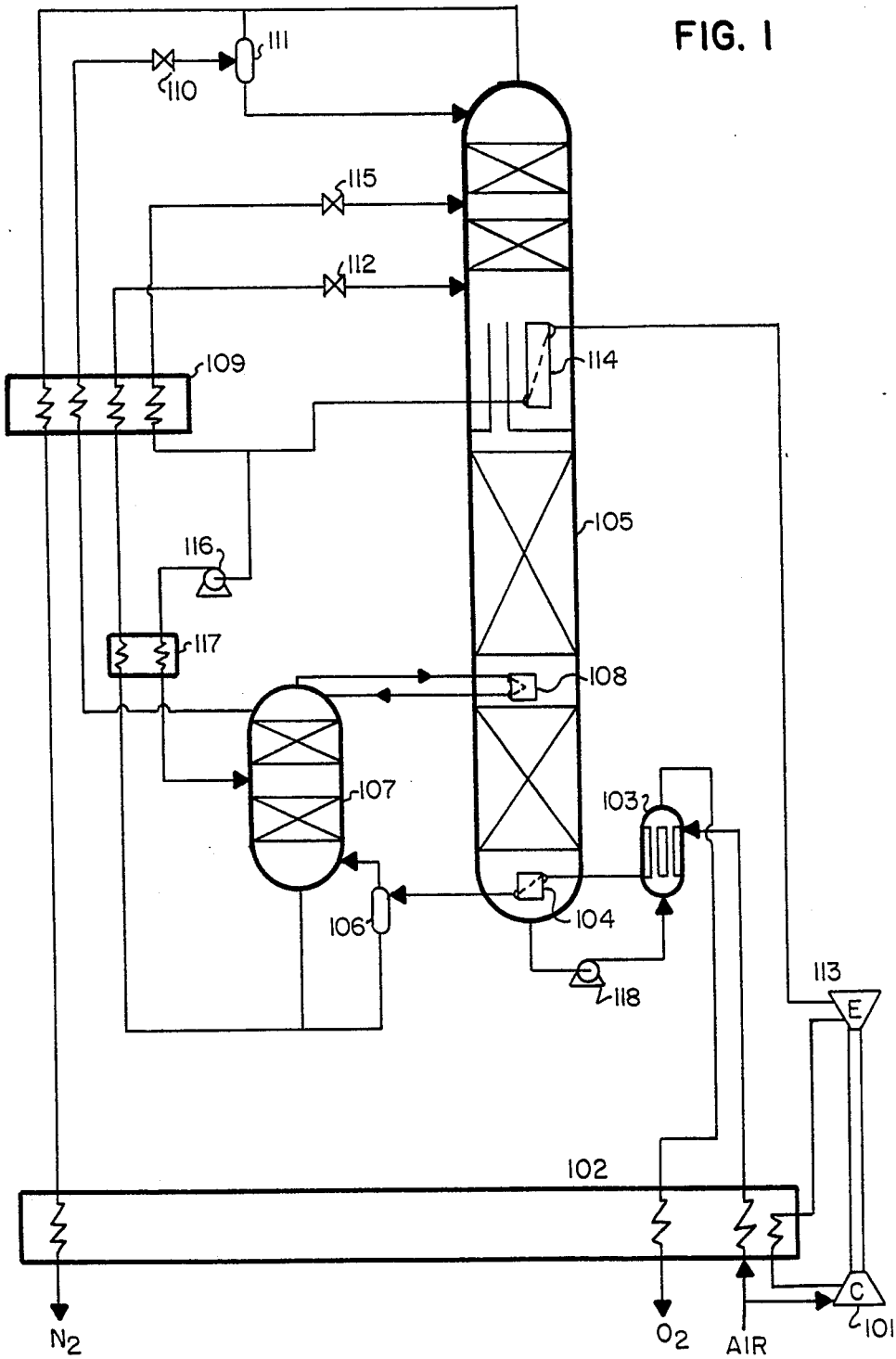
FIG. 1 is a simplified schematic flowsheet of a process for producing low purity oxygen (up to about 97% purity) which incorporates PC LOXBOIL, PC reboil of the LP column, AIRPER with liquid air split (LAIRSPLIT), and in which the expanded air is used to evaporate LP column intermediate height liquid from the feed height.

Referring to FIG. 1, compressed air that has preferably been dried and cleaned while arm, e.g., with molecular sieves, is split into a minor fraction which is further compressed by compressor 101, and a major fraction which is cooled to near the dew point in main exchanger 102. The major fraction is then directed to partial condensation liquid oxygen evaporator 103, and then on to the bottoms reboiler 104 of the LP $N_2$ rejection column 105. The partially condensed air is then optionally separated in phase separator 106, with at least the vapor fraction being fed to HP rectifier 107. HP rectifier overhead vapor provides intermediate reboil to LP column 105 at intermediate reboiler 108; the resulting liquid $N_2$ is used to reflux both rectifier 107 and LP column 105, after subcooling in heat exchanger 109 and depressurization by valve 110. Optional phase separator 111 can be used to ensure only liquid is supplied to column 105. The bottoms or kettle liquid from rectifier 107, combined with liquid from separator 106, is also cooled, depressurized by valve 112 and fed to LP column 105. The refrigeration air from compressor 101 is partially cooled and then work expanded to an intermediate pressure in turbine 113, which powers compressor 101. If the air out of turbine 113 is still appreciably superheated, it may optionally be further cooled; otherwise it is routed directly to intermediate reboiler 114, where it is totally condensed while supply intermediate reboil to LP column 105 at the feed tray height. The liquid air is split into two fractions, each comprising between 4 and 12% of the supply air. One fraction is depressurized by valve 115 and supplied to a intermediate reflux height of LP column 105; the other fraction is increased in pressure by pump 116 and supplied to an intermediate height of HP rectifier 107. The column 105 fraction can optionally be subcooled in heat exchanger 109, and the rectifier 107 fraction can optionally be heated in heat exchanger 117. The liquid oxygen bottom product from LP column 105 is transferred to evaporator 103 by pump 118 or other means for transport, depending on the relative elevations of reboiler 104 and evaporator 103. Gaseous oxygen and nitrogen are withdrawn via main exchanger 102. Other optional coproducts not shown include liquid oxygen from the sump of evaporator 103, liquid nitrogen, or high pressure gaseous nitrogen.

Figure 2:
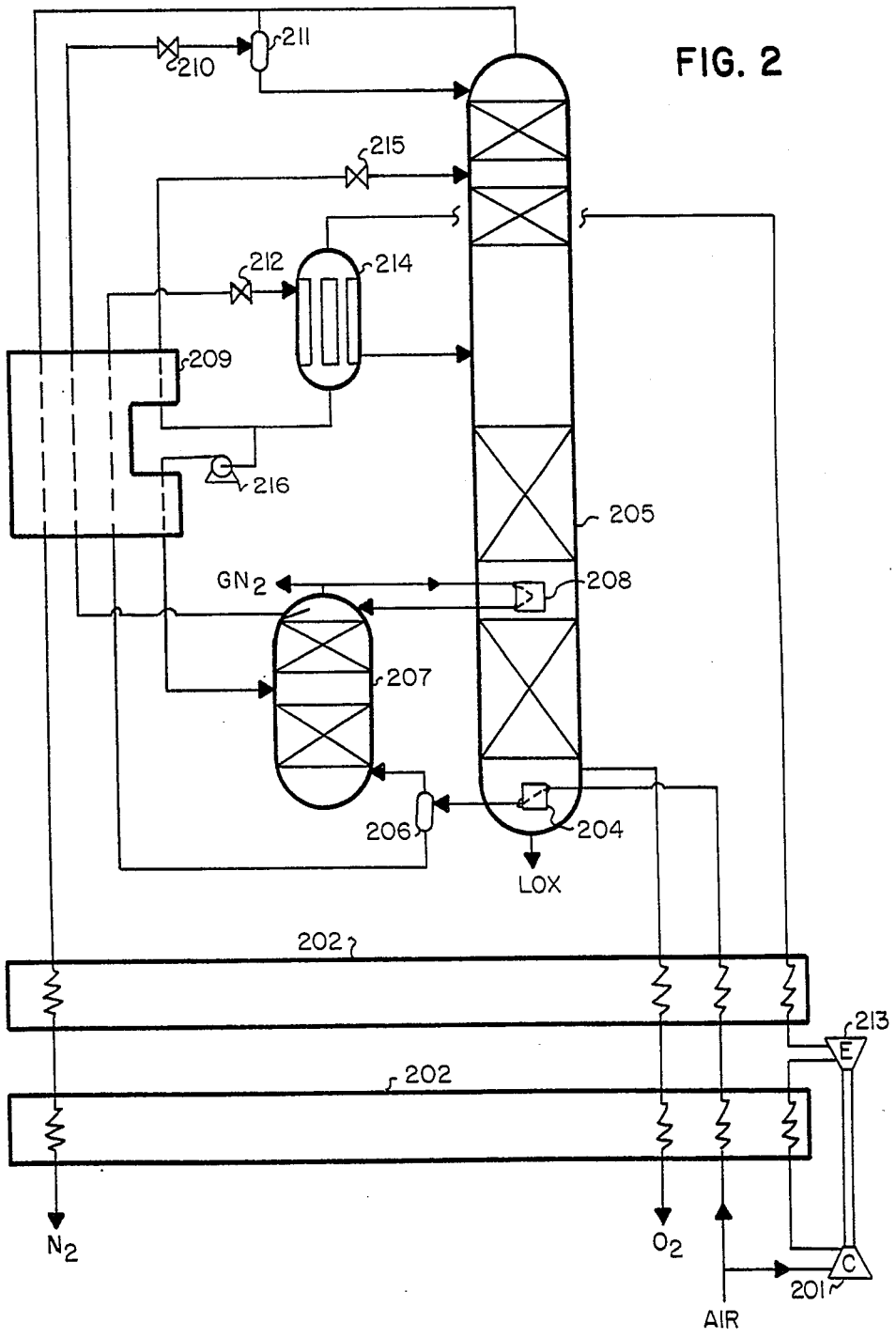
FIG. 2 shows a similar flowsheet wherein the expanded air partially evaporates the depressurized kettle liquid, and the two partial condensation exchangers are combined into one.

FIG. 2 illustrates a very similar flowsheet to that of FIG. 1 with only two substantive changes: reboiler 204 of FIG. 2 combines both the reboil and LOXBOIL duties which were performed respectively by reboilers 103 and 104 of FIG. 1; and latent heat exchanger 214 condenses the partially expanded air against depressurized kettle liquid (which is thereby partially evaporated) rather than against LP column intermediate feed height liquid as in FIG. 1. Less substantive changes that are exchanger 209 combines the duties of both heat exchangers 109 and 117 of FIG. 1, and that exchanger 202 is illustrated in 2 sections vice 1. Other 200 series components correspond to the description already given for the corresponding 100 series components, and will not be repeated.

Figure 3:
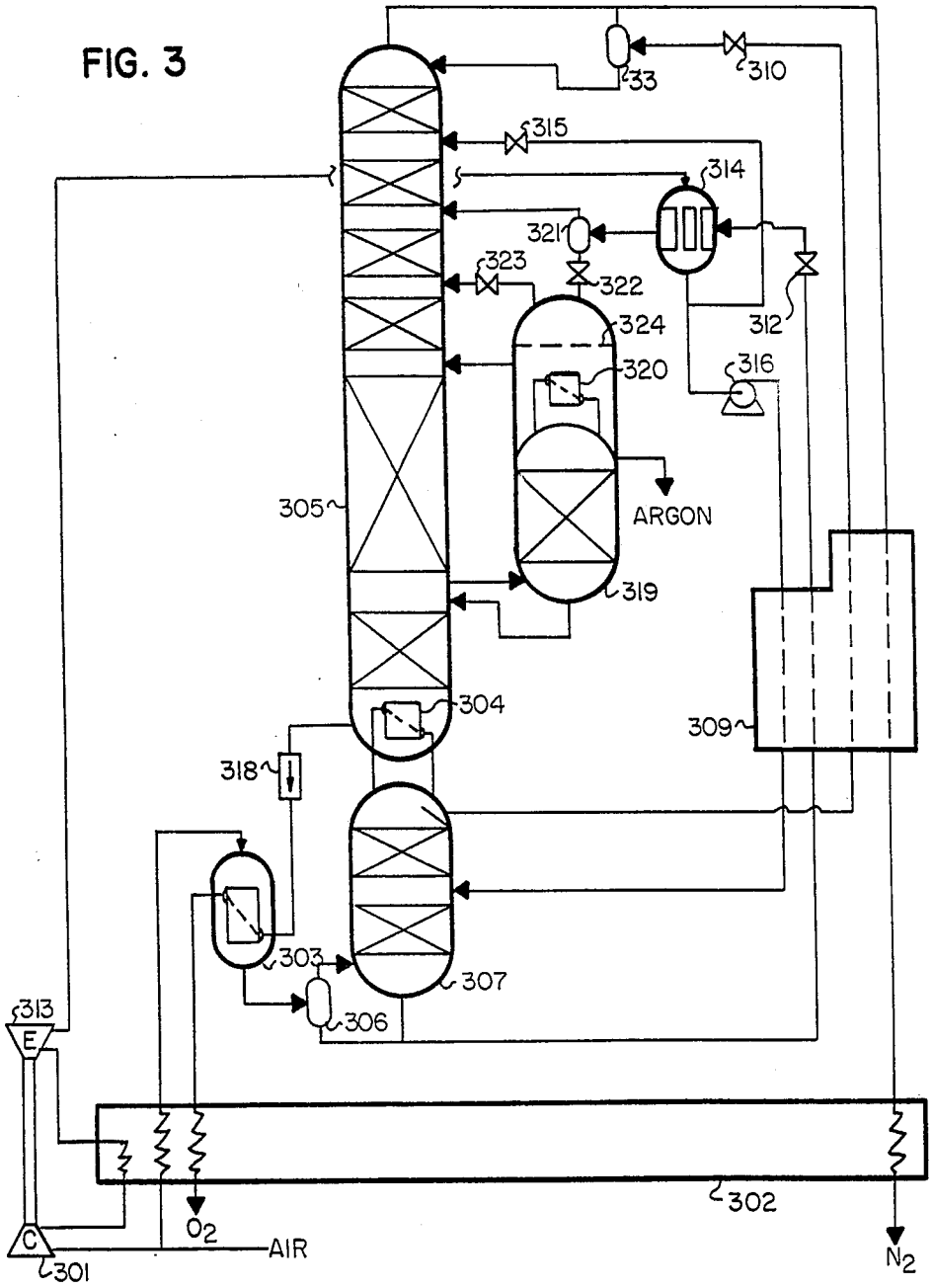
FIG. 3 illustrates the application of AIRPER to a dual pressure high purity $O_2$ (99.5% purity) flowsheet having an argon sidearm, and shows that with improved AIRPER it becomes possible to both increase argon recovery and increase $O_2$ delivery pressure via PC LOXBOIL, all while retaining full $O_2$ recovery. Finally.

FIG. 3 illustrates the application of improved AIRPER refrigeration to the conventional dual pressure column configuration with argon sidearm. Compressed, cleaned, and dried air is split, routing a minor fraction to warm compander 301, and the remainder to main exchanger 302. The cooled major fraction partially condenses in LOX evaporator 303, and the vapor fraction is routed to HP rectifier 307 after phase separation at separator 306. Overhead vapor from HP rectifier 307 reboils low pressure $N_2$ rejection column 305 at reboiler 304, thereby yielding liquid $N_2$ which refluxes both rectifier 307 and column 305 via subcooler 309 and depressurization valve 310 plus optional phase separator 311. Argon sidearm column 319 communicates with column 305 at a height where essentially all $N_2$ has been removed, and further concentrates the argon to about 95% purity for subsequent processing. The compressed minor air fraction from compressor 301 is cooled the minimum amount necessary to compensate main exchanger 302, then work expanded in expander 313 which powers compressor 301, and then (after optional further cooling) is condensed in latent heat exchanger 314 against evaporating kettle liquid which was depressurized by valve 312. Separator 321 feeds the vapor fraction to column 305, and the liquid fraction is routed via optional valve 322 to the reflux apparatus for sidearm 319. Reflux condenser 320 provides liquid reflux to sidearm 319 and further evaporates the kettle liquid before feeding to column 305. Preferably the reflux apparatus incorporates at least one stage of countercurrent vapor-liquid contact 324, e.g., a sieve tray, and a second vapor feed path to column 305 (one each from above and below the countercurrent contactor). The relative amounts of vapor flow through the two vapor paths can be controlled by valve 323. The objective of contactor 324 is to enable the vapor feed from below contactor 324 to have the maximum $O_2$ content possible, thereby maximizing the reboil rate through sidearm 319 and increasing the argon recovery. Liquid oxygen of high purity in the sump of column 305 is increased in pressure by means for pressurization 318 (which is preferably merely a check valve in a hydrostatic head column) and evaporated to gaseous product oxygen at LOX evaporator 303, and then withdrawn.

Conventional high purity $O_2$ flowsheets with argon sidearm cannot use PC LOXBOIL, because the $O_2$ recovery (and frequently also argon recovery) is reduce excessively by the required partial condensation of about 27% of the supply air. Thus the $LN_2$ reflux otherwise available from that air is no longer available, and recovery suffers. With the disclosed improved AIRPER, the $LN_2$ reflux requirements are greatly reduced such that PC LOXBOIL for the first time becomes advantageous. Also, by the sequential 2 or 3 step evaporator of the kettle liquid, whereby 2 or 3 vapor streams of differing composition are fed to the LP column, the column operates very efficiently and maximum reboil is possible through sidearm 319.

Figure 4:
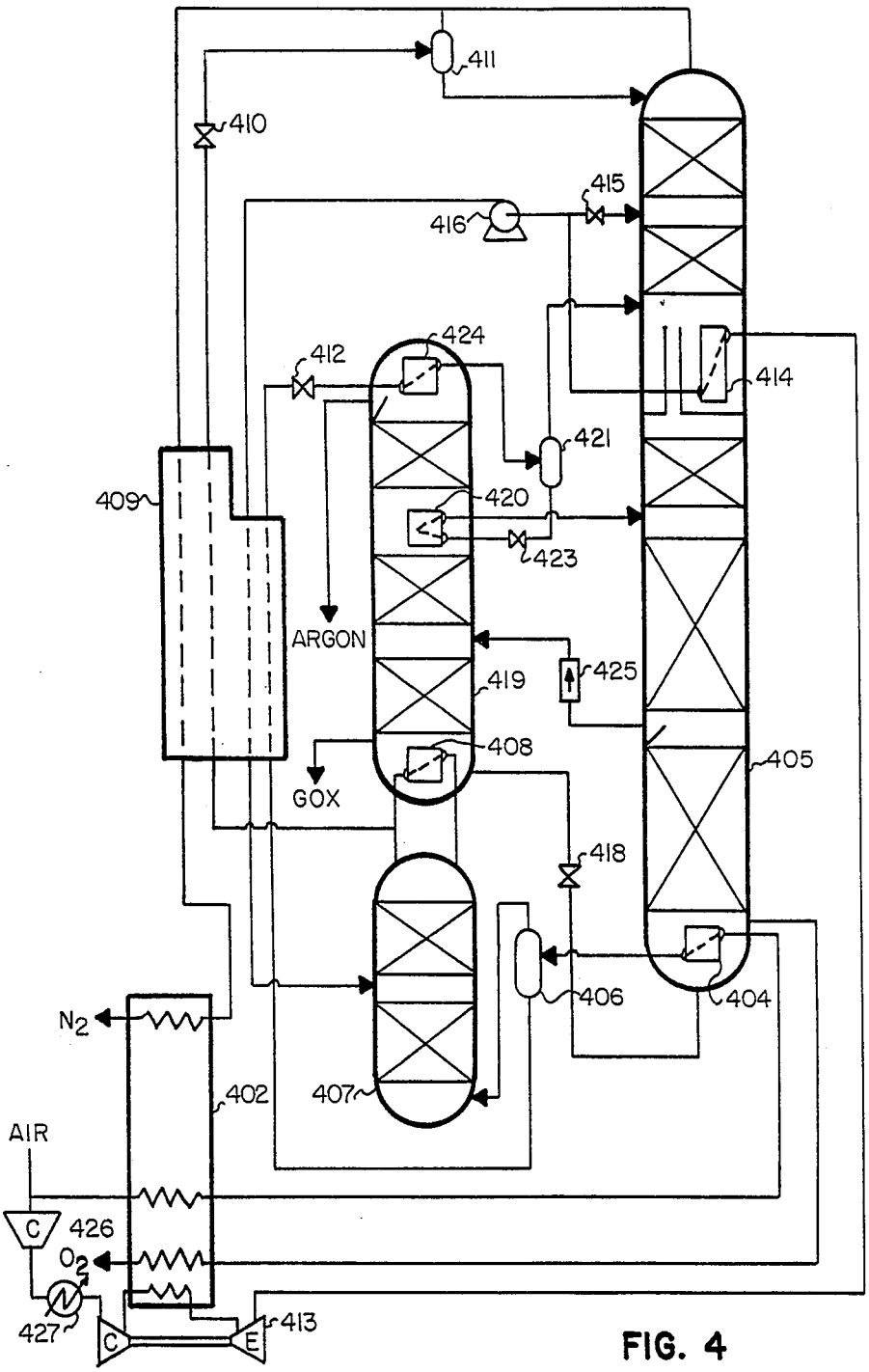
FIG. 4 illustrates the improved AIRPER technique is also applicable to triple pressure high purity $O_2$ flowsheets.

FIG. 4 illustrates high purity $O_2$ production plus coproduct argon in a triple pressure column arrangement, vice the dual pressure arrangement of FIG. 3. The oxygen-argon separation is effected in a separate column operating at even lower pressure than the low pressure $N_2$ rejection column 305 of FIG. 3. Since the $N_2$ rejection column 405 of FIG. 4 is reboiled by partially condensing air in reboiler 404, it can operate with the same very low supply pressures in the range of 55 to 75 psia as FIGS. 1 and 2, as opposed to the 75 to 90 psia supply pressure range typical of FIG. 3. Components 401, 402, 404–407, and 409–416 are similar in function to 100 series, 200 series, and 300 series components previously described. The argon column 419 includes both stripping and retification sections, and also 2 reflux condensers—424 and 420. Depressurized kettle liquid from value 412 is partially evaporated in condenser 424, and then separated by separation 421 and value 423 to a liquid fraction having even higher $O_2$ content and a vapor fraction which is fed to column 405 at the same height as the intermediate liquid used to condense AIRPER air in intermediate reboiler 414. The liquid from value 423 is evaporated in intermediate reflux condenser 414 and also routed to columnn 405, to a lower height (due to its higher $O_2$ content). Column 419 is fed liquid oxygen-argon mixture from an intermediate height of column 405 via means for transport 425. Although column 419 is at a lower pressure than column 405, e.g., 16 psia as opposed to 21 psia, nevertheless means for transport may be required to be a liquid pump due to the elevation difference. As much as possible of the gaseous oxygen product is withdrawn from the sump of column 405, at about 22 psia. Liquid oxygen bottom product from column 419 is transported to the column 405 sump via means for transport 418, which once again may be simply a control valve or check valve if the respective elevations are sufficiently different (hydrostatic head), but otherwise will be a liquid pump. In situations wherein not all the $O_2$ product can be gasified at reboiler 404, e.g., when appreciable quantities of $N_2$ coproduct are desired, some or all of the $O_2$ product can be withdrawn at lower pressure from the sump of column 419.

One beneficial measure which can be used to reduce or avoid the need to take some gaseous $O_2$ product from column 419 is to incorporate an additional externally powered compressor 426 in the refrigeration air line, either before or after compressor 401, and optionally also a cooler 427. By further increasing the pressure ratio of expansion, the required mass flow rate through expander 413 is further reduced, making more air available to drive reboiler 404. The required compressor is very small, since it only compresses a small fraction (10 to 15%) of the supply air which is already at pressure, and its power demand is only on the order of 1 or 2% of the main air compressor power. It provides a good variable reserve for upset conditions or nonstandard ambient conditions, thus reducing the reserve margin necessary in the remaining equipment. As such, it can be advantageous in all flowsheets incorporating AIRPER, not only the triple pressure one.

Whereas FIGS. 3 and 4 illustrate the preferred methods of refluxing the argon rectification section involving sequential evaporation of kettle liquid, it will be recognized that other reflux techniques are possible, such as direct exchange of latent heat from argon rectifier vapor to $N_2$ rejection column intermediate height liquid.

I claim:

1. Process for cryogenic distillation of compressed air to oxygen product plus optional crude argon byproduct comprising:
   (a) supplying an uncondensed fraction of the supply air to a high pressure (HP) rectifier;
   (b) withdrawing overhead liquid from the HP rectifier and feeding at least part of it to a low pressure nitrogen removal column as overheat reflux therefor;
   (c) work expanding a minor fraction of the supply air to an intermediate pressure;
   (d) condensing the expanded air by exchanging latent heat with at least one of $N_2$ removal column intermediate height liquid and at least part of the HP rectifier bottom liquid (kettle liquid); and
   (e) splitting the resulting liquid air into at least two fractions and feeding one fraction to an intermediate reflux height of the HP rectifier and another to the $N_2$removal column.

2. Process according to claim 1 further comprising directly supplying a major fraction of the supply air to the HP rectifier without preliminary partial condensation, and further comprising:
   (a) increasing the pressure of one of said fractions of liquid air before intermediate refluxing the HP rectifier with it;
   (b) additionally compressing the minor fraction of air to be work-expanded prior to said work expansion; and
   (c) powering said compression step with the work produced in said expansion step.

3. Process according to claim 1 further comprising:
   (a) depressurizing kettle liquid to the approximate pressure of said $N_2$ rejection column;
   (b) supplying said depressurized kettle liquid to said air condensing step;
   (c) partially evaporating said kettle liquid by exchanging latent heat with condensing air;
   (d) feeding at least the vapor fraction of the partially evaporated kettle liquid to the $N_2$ removal column;
   (e) condensing partially work-expanded air by said latent heat exchanging step in an amount which is between about 10 and 24 percent of the compressed air supply; and
   (f) supplying separate liquid air intermediate reflux stream to the HP rectifier and $N_2$ rejection column which are each between about 5 and 12 percent of the compressed air supply.

4. Process according to claim 1 further comprising reboiling $N_2$ rejection column intermediate height liquid from the same equilibrium stage as the optionally evaporated kettle liquid feed height by said latent heat exchange with expanded air.

5. Process according to claim 1 further comprising:
   (a) additionally compressing the minor fraction of supply air to be work expanded at least once prior to said work expansion;
   (b) cooling said minor fraction after compressing but before expanding; and
   (c) powering one of said additional compressions from work developed by said expansion and another by an external power source.

6. Process according to claim 1 further comprising:
   (a) partially condensing part of said compressed air prior to said supplying of the uncondensed fraction to the HP rectifier;
   (b) increasing the pressure of one of said fractions of liquid air before said feeding of it to the HP rectifier;
   (c) evaporating liquid oxygen bottom product from said $N_2$ rejection column by exchanging latent heat with said partially condensing air; and
   (d) providing at least one of $N_2$ rejection column bottoms reboil and gaseous oxygen product from said evaporating liquid oxygen.

7. Process according to claim 6 further comprising:
   (a) additionally compressing the minor fraction of air to be work expanded prior to said work expansion;

(b) powering said compression with the work produced by said expansion; and (c) exchanging latent heat between HP rectifier overhead vapor and $N_2$ rejection column intermediate height liquid, thereby providing overhead reflux to the HP rectifier and intermediate reboil to the $N_2$ rejection column.

8. Process according to claim 6 further comprising:

(a) reboiling the bottom of the $N_2$ rejection column by exchanging latent heat with HP rectifier overhead vapor;

(b) providing an argon sidearm column in vapor and liquid communication with the $N_2$ rejection column;

(c) withdrawing crude argon sidearm; and (d) increasing the pressure of the liquid oxygen bottom product from the $N_2$ rejection column prior to evaporating it by latent heat exchange with partially condensing supply air.

9. Process according to claim 8 further comprising:

(a) locating the liquid oxygen evaporator at a lower elevation than the bottom of the $N_2$ rejection column whereby at least part of the said pressure increase is obtained by the hydrostatic head of the liquid oxygen;

(b) at least partially evaporating depressurized kettle liquid in at least two sequential stages by exchanging latent heat with argon sidearm column vapor, thereby providing argon sidearm column reflux and at least two vapor streams of differing composition; and (c) feeding said two vapor streams to different heights of said $N_2$ rejection column.

10. Process according to claim 6 further comprising:

(a) providing an argon distillation column which is fed a liquid oxygen-argon mixture from the $N_2$ rejection column; and (b) reboiling the argon column by exchanging latent heat with HP rectifier overhead vapor.

11. Process according to claim 10 further comprising:

(a) additionally compressing the minor fraction of air to be work-expanded prior to said work expansion;

(b) powering said compression with the work produced by said expansion;

(c) refluxing the argon column overhead by exchanging latent heat with partially evaporated depressurized kettle liquid;

(d) refluxing an intermediate height of the argon column by exchanging latent heat with the remaining unevaporated kettle liquid; and (e) feeding the vapor streams from steps (c) and (d) to different heights of the $N_2$ rejection column.

12. Process according to claim 10 further comprising (a) additionally compressing the minor fraction of air to be work-expanded prior to said work expansion;

(b) powering said compression with an external source of power;

(c) selecting the $N_2$ rejection column feed location as the height from which intermediate height liquid is obtained for latent heat exchange with expanded air; and (d) evaporating at least a major fraction of the gaseous oxygen product by said step of exchanging latent heat with partially condensing air.

13. In a process for separating air into valuable products by cryogenic fractional distillation comprising rectifying supply air in a high pressure column; distilling depressurized and optionally evaporated bottom liquid from the high pressure column into at least overhead $N_2$ and bottoms $O_2$ in a low pressure column; and refluxing the low pressure column by injecting liquid $N_2$ overhead product from the HP column into the LP column overhead; the improvement comprising producing refrigeration for said air separation process by:

(a) work expanding a minor fraction of said supply air;

(b) condensing said expanded air by exchanging latent heat with at least one of low pressure column intermediate height liquid and depressurized high pressure column bottom liquid;

(c) splitting the condensed air into two fractions;

(d) feeding one fraction to a higher intermediate height of the low pressure column as intermediate reflux therefor; and (e) increasing the pressure of the remaining fraction of condensed air and feeding it to an intermediate height of the high pressure column as intermediate reflux therefor.

14. A process for producing at least one of oxygen, nitrogen, and coproduct crude argon from compressed air by fractional distillation comprising:

(a) rectifying an uncondensed major fraction of the compressed air in a high pressure rectifier to liquid nitrogen overhead product and oxygen enriched liquid bottom product (kettle liquid);

(b) additionally compressing a minor fraction of said compressed air;

(c) work expanding said fraction of the compressed air to an intermediate pressure;

(d) powering said additional compression by the work obtained from said expansion;

(e) condensing the expanded air by exchanging latent heat with depressurized kettle liquid, thereby partly evaporating said kettle liquid;

(f) distilling the at least partly evaporated kettle liquid to gaseous overhead $N_2$ and fluid $O_2$ bottom product in a low pressure distillation column (LP column);

(g) splitting said condensed air into two approximately equal fractions;

(h) supplying one fraction to an intermediate height of the low pressure column; and (i) increasing the pressure of the remaining fraction and supplying it to an intermediate height of the high pressure rectifier.

15. Process according to claim 14 further comprising:

(a) partially condensing said compressed air prior to said supplying of the uncondensed major fraction to the HP rectifier; and (b) evaporating liquid oxygen bottom product from said LP column by exchanging latent heat with the partially condensing compressed air; and (c) providing at least one of LP column bottoms reboil and gaseous oxygen product from said evaporating liquid oxygen.

16. Apparatus for cryogenic fractional distillation of compressed air comprising:

(a) a high pressure column which is supplied an uncondensed major fraction of said compressed air;

(b) a lower pressure column which is refluxed with liquid $N_2$ from the overheat product of said HP rectifier;

(c) a work expander which is supplied a minor fraction of said compressed air after partial cooling;

(d) at least one latent heat exchanger which is supplied expanded air from said work expander and one of depressurized kettle liquid and LP column feed height liquid;

(e) means for splitting the condensed air from said latent heat exchanger into two fractions;

(f) means for supplying one of said liquid fractions to an intermediate height of the LP column; and (g) means for pressurizing the remaining fraction and supplying it to an intermediate height of said HP column.

17. Apparatus according to claim 16 wherein said means for pressurization is a liquid pump and further comprising:

(a) latent heat exchanger for evaporating liquid oxygen bottom product from said LP column via partial condensation of said major air fraction; and (b) means for compressing said minor fraction of air prior to said expansion, said means for compressing being powered by said work expander.

* * * * *